United States Patent [19]

Hellenbrand et al.

[11] Patent Number: 4,591,124

[45] Date of Patent: May 27, 1986

[54] HOSPITAL BED READING BOOK SUPPORT

[76] Inventors: Odon Hellenbrand, both of 233 Broadway, Rm 3615, New York, 10007; George Spector, both of New York, N.Y.

[21] Appl. No.: 694,530

[22] Filed: Jan. 24, 1985

[51] Int. Cl.[4] ..... A47B 23/00

[52] U.S. Cl. ..... 248/447.2; 248/464; 248/284; 248/454

[58] Field of Search ..... 248/447.1, 447.2, 449, 248/460, 464, 465, 284, 454; 5/507

[56] References Cited

U.S. PATENT DOCUMENTS

| | | | |
|---|---|---|---|
| 409,852 | 8/1889 | Merrill | 248/284 |
| 1,221,369 | 4/1917 | Osborn | 248/460 |
| 1,797,847 | 3/1931 | Vandagriff | 5/507 |
| 1,903,314 | 4/1933 | Ornberg | 248/284 |
| 2,678,792 | 5/1954 | Gallion | 5/507 |
| 3,127,114 | 3/1964 | Shaw | 248/447.2 |
| 3,905,573 | 9/1975 | Davis | 248/284 |
| 4,021,013 | 5/1977 | Wiersma | 248/447.2 |
| 4,165,856 | 8/1979 | Wiseheart | 248/449 |

FOREIGN PATENT DOCUMENTS

| | | | |
|---|---|---|---|
| 502207 | 1/1954 | Italy | 248/284 |

*Primary Examiner*—Reinaldo P. Machado
*Assistant Examiner*—Alvin Chin-Shue

[57] ABSTRACT

A hospital bed reading book support with fluorescent lamp attachment which has a book rest, an adjustable lamp, a pivotal upper vertical post, a pivotal horizontal post, and a slideable lower vertical post. All moveable parts may be locked by use of wing nut and bolt assemblies which allow both the book support which is attached to the bed rail and the lamp to assume a number of different positions to accomodate the comfort of a patient in a hospital bed.

2 Claims, 4 Drawing Figures

HOSPITAL BED READING BOOK SUPPORT

BACKGROUND OF THE INVENTION

The present invention relates to a hospital bed reading book support with florescent lamp attachment. More particularly, it relates to a hospital bed reading book support with florescent lamp attachment which is adjustable in a number of directions and may assume a number of positions.

Reading book supports of the above mentioned general type are known in the art. For example, U.S. Pat. No. 208,039 to Schoch teaches a book support, per se, that may assume a number of different positions but does not contain a florescent lamp attachment and due to its configuration is not designed to be clamped to a bed rails.

Another example, U.S. Pat. No. 376,593, to Greenawalt et al, teaches a book holder that may assume a number of different positions but does not contain a florescent lamp attachment and its book rest is not pivotally adjustable with respect to its upper vertical post. A final example, U.S. Pat. No. 3,351,312, to Ballas teaches a complex book holder arrangement which utilizes a flexible rod that is supported by a string arrangement which allows it to achieve a number of different positions.

SUMMARY OF THE INVENTION

It is the primary object of the present invention to provide a book support which avoids the disadvantages of the prior art.

It is another object of the present invention to provide a book support that can be clamped to the rail of a hospital bed.

It is still another object of the present invention to provide a book support that has a florescent lamp attachment.

It is yet another object of the present invention to provide a book support which may assume a number of different positions with regard to both the book rest and the florescent lamp attachment so as to provide a comfortable and convenient position for the patient.

Further objects of the invention will appear as the description proceeds.

To the accomplishment of the above and related objects this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figure 1:
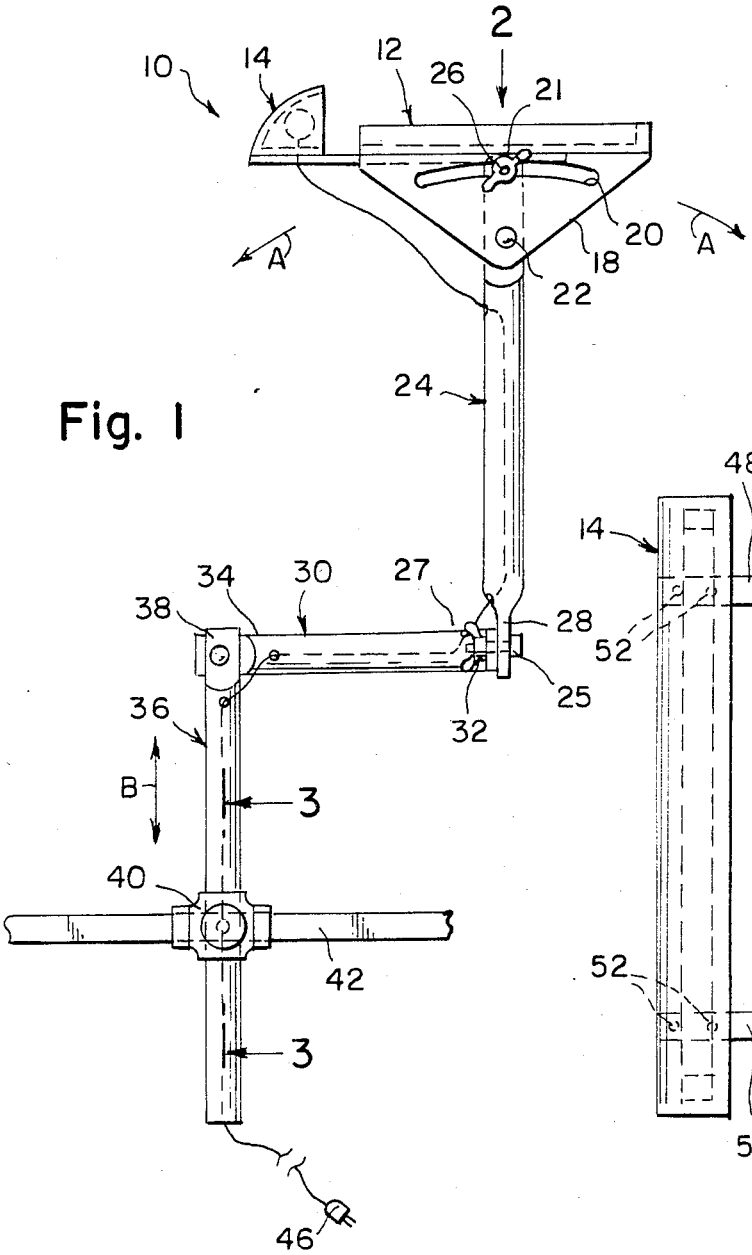
FIG. 1 is a side view of the invention mounted to a bed rail.

Referring now to FIG. 1, the book support with lamp attachment is shown generally at 10 and has a book rest 12 and a lamp assembly 14 which is mounted to the book rest 12. A side plate 18 is affixed substantially perpendicular to the bottom side of the book rest 12 and contains a curved channel 20. The side plate 18 is pivotally mounted at a pivot point 22, to an upper vertical post 24. The book rest 12 is pivotally adjustable by way of wing nut and bolt assembly 26 which is mounted at an end 21 of the post 24 and is slideable in the channel 20. This allows the book rest 12 to pivot in the directions of arrow A.

Pivotally attached to the other end 28 of the post 24 at a pivot point 25, is a horizontal post 30 which can be locked in place with respect to the post 24 by way of a wing nut and bolt assembly 32 that is arranged at an end 27 of the post 30. The upper vertical post 24 is pivotable in a plane that is perpendicular to the longitudinal axis of the horizontal post 30.

Pivotally attached to the other end 34 of the post 30, by an end 38, is a slideable lower vertical post 36. The post 36 is vertically slideable in the directions of arrow B, and is slideably mounted in a tee bracket 40 which is attached to a bed rail 42. A power wire 42 originates at the lamp 14 and is snaked through the interior of the shafts 24, 30 and 36 from which it terminates with a conventional A.C. plug 46.

Figure 2:
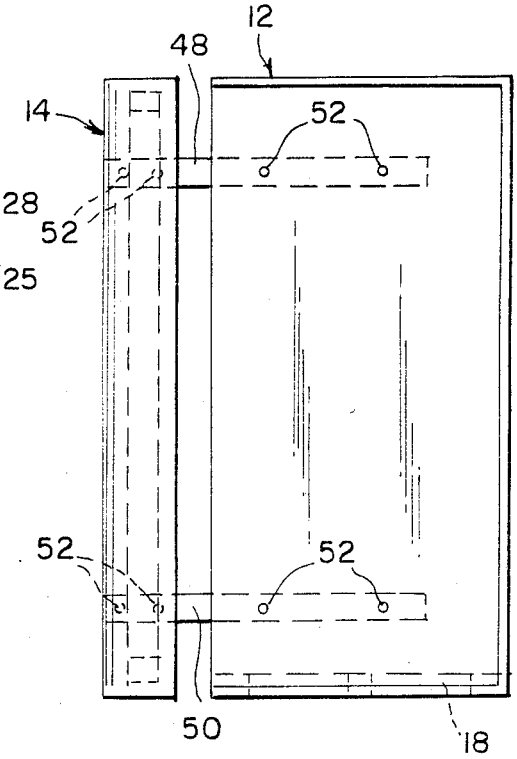
FIG. 2 is a top view of the book support as indicated by the arrow 2.

As shown in FIG. 2, the lamp 14 is attached to the book rest 12 by means of two support brackets 48 and 50. The two brackets 48 and 50 are attached to the underside of the lamp 14 and the book rest 12 by way of screws 52.

Figure 3:
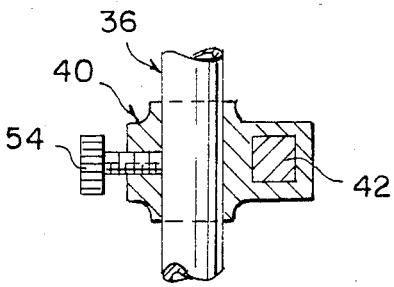
FIG. 3 is a cross sectional view taken along 3—3 in FIG. 1 showing the cross type mounting clamp.

The tee bracket 40 shown in FIG. 3, is mounted to the bed rail 42 and secures the vertically adjustable post 36 by means of a turn 54.

Figure 4:
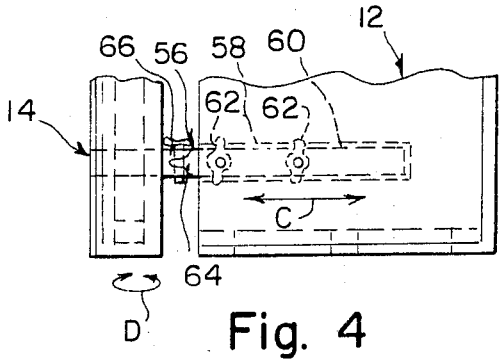
FIG. 4 is a partial top view similar to FIG. 2 of a modification showing an adjustable lamp support bracket.

In FIG. 4, a modified version of the lamp support bracket is shown at 56. In this embodiment, "U" channels 58 are attached to the underside of the book rest 12 and slidingly receive lamp support bracket arms 60. When the proper position of the lamp 14, which is moveable in the directions of arrow C, is achieved relative to the book rest 12, wing nuts 62 are tightened.

Additionally, the lamp 14 is pivotally adjustable in the directions of arrow D, about a pivot joint 64 which is tightened by a wing nut and bolt assembly 66.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A hospital bed reading book support with a lamp attached, comprising:

(a) an uppermost book rest;

(b) a lamp affixed to said book rest;

(c) an upper post pivotable in a vertical plane having an upper end and a lower end, said upper end being pivotally connected to a lower portion of said book rest whereby said book rest can pivot in a plane perpendicular to the first said plane to assume a number of different positions towards and away from the reader;

(d) means for locking said book rest in each of said number of different positions comprising a pivotable plate affixed to said lower portion having a slot slidable about a wing nut and bolt;

(e) a horizontal post having a first end, a second end and a longitudinal axis, said first end of said horizontal post being pivotably connected to said lower end of said upper post so that said upper post may pivot in a plane that is perpendicular to said longitudinal axis of said horizontal post and assume a number of different positions laterally towards and away from the reader;

(f) means for locking said upper vertical post in each of said number of different positions;

(g) a lower vertical post having an upper end pivotally connected to said second end of said horizontal post so that said horizontal post may pivot in a vertical plane thereby lowering or raising the book rest;

(h) means for locking said horizontal post in each of said number of different positions;

(i) a tee bracket fixedly attached to a rail of the hospital bed and containing a throughbore for slidingly receiving a lower end of said lower vertical post so that said lower vertical post may slide up and down with respect to said tee clamp and assume a number of different positions; and (j) means for locking said lower vertical post in each of said number of different positions.

2. The book support as defined in claim 1, wherein said lamp is adjustably mounted relative to said book rest and includes means for pivotal adjustment in a plane parallel to the second said plane and means for lateral adjustment perpendicular to said upper vertical post wherein said means for lateral adjustment includes at least one bracket attached to said lamp and at least one "U" channel attached to said book rest and at least one pair of thumb screws threadably mounted to each of said at least one "U" channel, each of said at least one bracket of said lamp being inserted into a respective one of said at least one "U" channel to achieve the desired lateral position and at which time a respective pair of said at least one pair of thumb screws are tightened, said means for pivotable adjustment includes a pivot joint on said bracket.

* * * * *